US005253678A

United States Patent [19]

Furugen

[11] Patent Number: 5,253,678

[45] Date of Patent: Oct. 19, 1993

[54] LONG TUBE HAVING A SMALL DIAMETER

[75] Inventor: Munekatsu Furugen, Amagasaki, Japan

[73] Assignee: Sumitomo Metal Industries, Ltd., Osaka, Japan

[21] Appl. No.: 979,405

[22] Filed: Nov. 19, 1992

Related U.S. Application Data

[60] Continuation of Ser. No. 760,124, Sep. 16, 1991, abandoned, which is a division of Ser. No. 714,998, Jun. 14, 1991, Pat. No. 5,076,084, which is a continuation of Ser. No. 497,662, Mar. 23, 1990, abandoned.

[30] Foreign Application Priority Data

Mar. 27, 1989 [JP] Japan ..... 1-75620
Jul. 10, 1989 [JP] Japan ..... 1-178690

[51] Int. Cl.[5] ..... F15D 1/00

[52] U.S. Cl. ..... 138/39; 138/37; 138/177

[58] Field of Search ..... 138/138, 139, 177, 37, 138/38; 72/41, 370, 283

[56] References Cited

U.S. PATENT DOCUMENTS 1,076,545 10/1913 Blaxter .
2,369,629 2/1945 Wood et al. ..... 138/139
3,021,596 2/1962 Yowell et al. ..... 72/370
3,661,005 5/1972 Petersen et al. ..... 72/370
3,798,943 3/1974 Benteler et al. .

FOREIGN PATENT DOCUMENTS 3048314 7/1982 Fed. Rep. of Germany ..... 72/370
54-37059 3/1979 Japan .
54-19221 7/1979 Japan .
0105804 8/1981 Japan ..... 72/41
57-64411 4/1982 Japan .
60-621 1/1985 Japan .
0130415 7/1985 Japan ..... 72/370
62-39045 8/1987 Japan .

*Primary Examiner*—Lowell A. Larson
*Assistant Examiner*—Michael J. McKeon
*Attorney, Agent, or Firm*—Burns, Doane, Swecker & Mathis

[57] ABSTRACT

A method of manufacturing a long tube having a small diameter, such as a tube for use in a heat exchanger, by cold working. A plug drawing using a pressurized lubricating oil of 500 kgf/cm$^2$ or more accompanied by the reduction in wall-thickness is adopted as at least the final cold work. In the case where a tube having desired dimensions is not obtained by this plug drawing, subsequent free-loaded drawing can be conducted.

18 Claims, 12 Drawing Sheets

LONG TUBE HAVING A SMALL DIAMETER

This application is a continuation of application Ser. No. 07/760,124, filed Sep. 16, 1991, now abandoned, which is a divisional of application Ser. No. 07/714,998, filed Jun. 14, 1991, now U.S. Pat. No. 5,076,084, which is a continuation of application Ser. No. 07/497,662, filed Mar. 23, 1990 now abandoned.

BACKGROUND OF THE INVENTION

1. Field of the Invention

The present invention relates to a method of manufacturing a long tube having a small diameter for the manufacture of a tube having an outside diameter of 40 mm or less and a length of 15 m or more, such as tubes for use in the heat exchange in the thermoelectric power plant, the nuclear power plant and the like, requiring a remarkably high quality.

2. Description of Related Art

The heat exchange tube incorporated into heat exchangers, such as a steam generator and water-supply heater, in a thermoelectric power plant and nuclear power plant has an outside diameter of 40 mm or less and it is manufactured by bending a long tube having a length of 20 m or more in a U-letter shape. This U letter-shaped heat exchange tube is subjected to internal eddy-current defect detection for inspection prior to actual use after being incorporated into the heat exchanger and a periodic inspection is performed after use of the tube for a predetermined time. To this end, a defectoscope disclosed in for example Japanese Patent Publication No. 60-621 is used. It goes without saying that the inspection standards of this internal eddy-current defect detection are remarkably severe for the U letter-shaped heat exchange tubes used in the thermoelectric power plant and the nuclear power plant with respect to safety.

A similar internal eddy-current defect detection has been required also for straight long tubes used as materials of the U letter-shaped heat exchange tubes. The results of the defect detection for these straight long tubes are administrated for every one piece of tube so that they may be compared in relation to the results of the defect detection for the heat exchange tubes in the pre-use inspection after they have been formed in a U-letter shape and the results of the periodic detection for the in-use heat exchange tubes. It is natural that articles of inferior quality are removed on the basis of the judgment of success or failure in the internal eddy-current defect detection of the long tubes. It has been required also for the successful tubes that the results of the internal eddy-current defect detection are recorded in relation to the positions along the axis of the tube for every one piece of tube.

The straight long tubes, which are materials for the U letter-shaped heat exchange tubes used for the thermoelectric power plant and the nuclear power plant, are manufactured by cold work from mother tubes, such as seamless tubes produced by the hot tube manufacturing method or welded tubes produced by welding. Of the cold work methods, methods accompanied by the reduction in wall-thickness generally include the plug drawing method, the cold rolling method and the mandrel drawing method.

In the plug drawing method, in general, chemically formed coatings and lubricating oils have been used as lubricants. In the case where the chemically formed coatings are used, also the mother tubes are long in the drawing of the long tubes, so that the mother tubes are not sufficiently chemically coated until the depths thereof according to circumstances. In this case, injuries due to jamming are produced at poorly lubricated portions of the drawn long tubes. In addition, in the case where the lubricating oils are used, the lubricating capacity is inferior to that of the chemically formed coatings, so that jamming is apt to occur on the internal side. Accordingly, the plug drawing method is difficult to adopt for the cold work of the long tubes under the usual condition.

In the cold rolling method, although the long tubes can be manufactured without bringing about the jamming, the rolling is conducted by intermittently pushing the mother tubes in the rolling-mill in synchronization with the reciprocal movement of a pair of taper-grooved rolls, so that the dimensional fluctuation in the axial direction of the tube corresponding to this intermittent pushing is unavoidably brought about. Accordingly, the cold rolling method is difficult to adopt for the final cold work of highly accurate long tubes such as the materials of the U letter-shaped heat exchange tubes.

Contrary to the above described methods, the mandrel drawing method is a method in which a mandrel having an outside diameter corresponding to an inside diameter of the long tubes is inserted into the mother tubes to draw out the mother tubes together with the mandrel. The relative movement of the internal surface of the mother tubes relative to the internal tool is smaller than that in the plug drawing method and even the long tubes do not show the jamming on the internal surface thereof. In addition, the drawing is continuously conducted, so that the dimensional fluctuation in the axial direction of the tubes incidental to the cold rolling method is not brought about during the work. Accordingly, this mandrel drawing method has been adopted for the final cold work accompanied by the reduction in wall-thickness of the long tubes for use in the U letter-shaped heat exchange tubes.

However, in this mandrel drawing method, a process of integrally reeling both the long tubes stuck to the mandrel and the mandrel to form a gap therebetween is required in order to separate the long tube from the mandrel after the drawing. As a result, the very small periodical spiral fluctuation in outside diameter is unavoidably brought about in the long tubes by this reeling process. Even though the long tubes, which have been separated from the mandrel, are subjected to the unloaded drawing for uniforming the outside diameter in the axial direction thereof, this very small fluctuation in outside diameter is merely converted into a very small fluctuation in inside diameter. Accordingly, the fluctuation in wall-thickness in the axial direction of the tube can not be solved at all.

If the long tubes showing the very small dimensional fluctuation in the axial direction thereof are subjected to the above described internal eddy-current defect detection having the severe standards, a signal resulting from this very small dimensional fluctuation is detected as a noise. As a result, also in the case where very small defects exist in the long tubes, the defect signals are hidden in the dimensional fluctuation signal, whereby the very small defects are overlooked by the automatic judgment according to circumstances.

The automatic judgement based on an output signal of the defectoscope is impossible and at present an inspector carries out the defect detection by staring at the CRT. When a doubtful signal is output, that portion is subjected to the defect-detection again at a lower speed to detect very small defect signals. As a result, the defect-detecting efficiency is remarkably reduced and the fatigue of the eyes of the inspector is increased.

An apparatus adopting the plug drawing method using a pressurized lubricating oil, which is one kind of the plug drawing method, has been disclosed in Japanese Patent Publication No. 62-39045. This apparatus has been developed by the present applicant and with it, a vessel with a mother tube inserted thereinto is filled with a lubricating oil under a high pressure and the mother tube is drawn out of the vessel under such a condition while it is subjected to the plug drawing. According to this method, the lubricating oil is sufficiently spread over inner and outer surfaces of even the tube, for which the chemically formed coating must be used as the lubricant, that is, this method is superior to the method using the chemically formed coating in jamming-prevention effect.

SUMMARY OF THE INVENTION

The present inventor has continued the investigation of plug drawing using a pressurized lubricating oil (hereinafter called the pressurized lubricant drawing for short) from the time when it was developed and recently conducted also the investigation of the manufacture of long tubes having small diameters. Furthermore, the present inventor has found from his investigation of the long tubes having small diameters that the superior lubricancy can be given to the long tubes having small diameters by the pressurized lubricant drawing; in the case where the long tubes having small diameters for use in U letter-shaped heat exchange tubes are manufactured by the mandrel drawing, the pressurized lubricant drawing is effective for the elimination of the small fluctuation of outside diameter in the axial direction of the tube called in question in the internal eddy-current defect detection; in other words, the pressure of the lubricating oil in the pressurized lubricant drawing has a great influence upon the lubricancy and thus the small fluctuation of outside diameter.

According to the method of the present invention, in the manufacture of the long tubes having small diameters used for the heat exchange tubes by the cold work, plug drawing using pressurized lubricating oil of 500 kgf/cm$^2$ or more accompanied by the reduction of wall-thickness is used as the final cold work. In the case where the long tubes having small diameters are manufactured by one step of cold working, the plug drawing using the pressurized lubricating oil of 500 kgf/cm$^2$ or more accompanied by the reduction of wall-thickness is used as this one cold working step. In addition, in the case where the long tubes having small diameters are manufactured by a plurality of cold working steps, the plug drawing using the pressurized lubricating oil of 500 kgf/cm$^2$ or more accompanied by the reduction of wall-thickness is used as at least the final cold work and the remaining cold working steps may be plug drawing accompanied by the reduction of wall-thickness or cold rolling or mandrel drawing.

In addition, in the case where the tube does not yet have the required size after the final cold work accompanied by the reduction of wall-thickness, which is the plug drawing, the free-loaded drawing is successively conducted.

The pressure of the pressurized lubricating oil used in the plug drawing is preferably 1,000 kgf/cm$^2$ or more but 1,500 kgf/cm$^2$ or less. In addition, the working degree of the tube in the plug drawing is set at 20 to 50%. Furthermore, the working degree in the free-loaded drawing is set at 20% or less, preferably 10% or less.

It is an object of the present invention to provide a method of manufacturing a long tube having a small diameter with preventing the long tube having a small diameter from jamming.

It is another object of the present invention to provide a method of manufacturing a long tube having a small diameter capable of almost perfectly preventing a very small fluctuation of outside diameter acting upon an internal eddy-current defect detection.

It is a further object of the present invention to provide a method of manufacturing a long tube having a small diameter capable of almost perfectly preventing very small fluctuations of the outside diameter to suppress noises resulting from the dimensional fluctuation, thereby allowing easy and accurate detecting of very small defects in the internal eddy-current defect detection.

It is a still further object of the present invention to provide a method of manufacturing a long tube having a small diameter capable of more easily manufacturing the long tube having a small diameter with almost perfectly preventing very small fluctuations of outside diameter and without jamming by conducting the free-loaded drawing after the pressurized lubricant drawing.

The above and further objects and features of the invention will more fully be apparent from the following detailed description with accompanying drawings.

DESCRIPTION OF THE PREFERRED EMBODIMENTS

The present invention manufactures long tubes having small diameters (typically an outside diameter of 40 mm or less and a total length of 25 m or more) for use in heat exchangers, which have been manufactured mainly by mandrel drawing, by plug drawing using a pressurized lubricating oil of 500 kgf/cm$^2$ or more.

Figure 1:
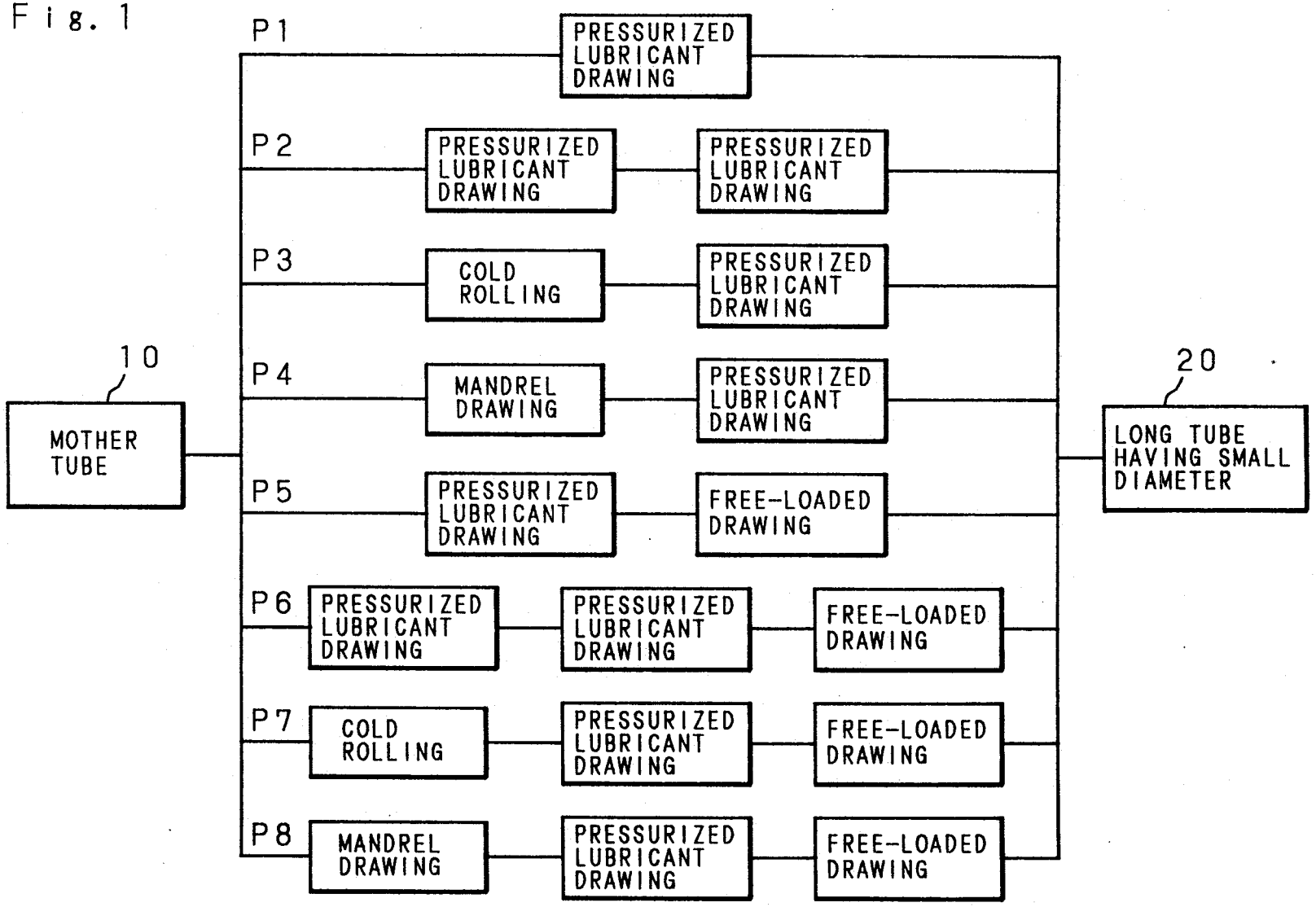
FIG. 1 is a chart showing manufacturing processes according to the present invention.

FIG. 1 is a chart showing manufacturing processes according to the present invention. The present invention is described herein with reference to 8 preferred embodiments as shown in processing routes P1 to P8 in FIG. 1. In general, a mother tube 10 formed of a seamless tube or a welded tube is subjected to one or more steps of cold work to manufacture a long tube 20 having a small diameter and the required size and quantity 20 (hereinafter referred to as the long tube 20).

Figure 2:
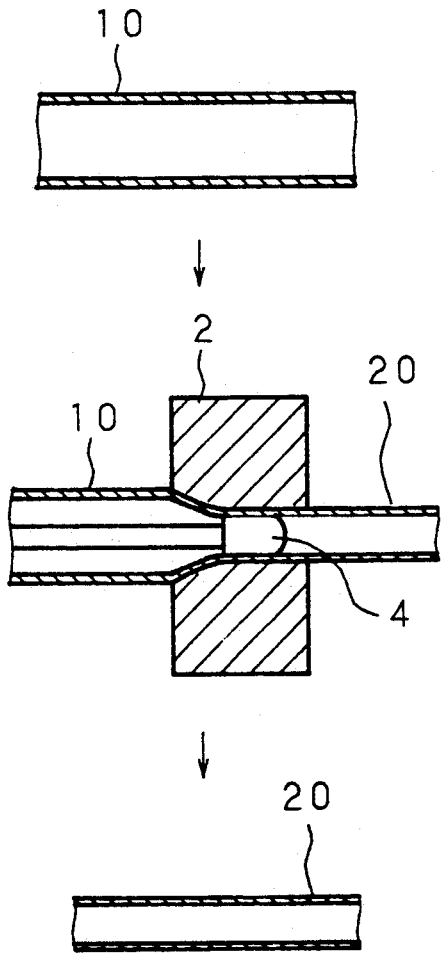
FIG. 2 is a schematic diagram showing a process according to a first preferred embodiment of the present invention.

Initially, the first preferred embodiment (P1 in FIG. 1) is described. FIG. 2 is a schematic diagram showing a process in the first preferred embodiment. The mother tube 10 formed of a seamless tube or a welded tube is subjected to pressurized lubricant drawing to manufacture the long tube 20 as the product.

Figure 3:
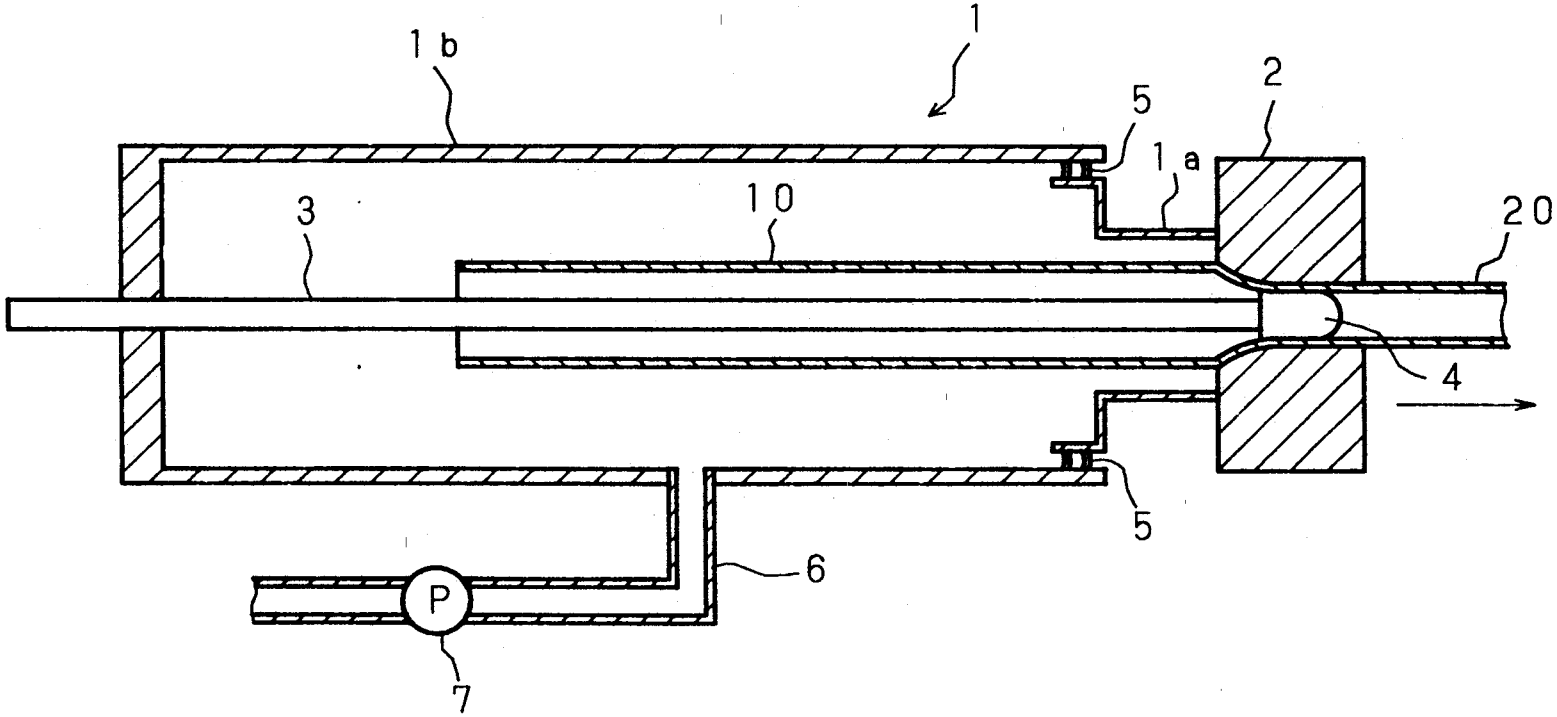
FIG. 3 is a schematic diagram showing a work condition of the plug drawing using a pressurized lubricating oil used in the method according to the present invention.

The pressurized lubricant drawing in the method according to the present invention can be put into practice by the use of, for example, an apparatus disclosed in Japanese Patent Publication No. 62-39045 filed by the present applicant. FIG. 3 is a schematic sectional view showing a work condition of the pressurized lubricant drawing.

Referring to FIG. 3, reference numeral 1 designates a vessel comprising a hollow cylindrical stepped end member 1*a* and a bottomed cylindrical base end member 1*b*, a base end portion of the stepped end member 1*a* being put in a leading open end portion of the base end member 1*b* through a packing 5. The vessel 1 is thus opened at the stepped end thereof and closed in a base end thereof as a whole. The leading end portion of the stepped end member 1*a* of the vessel 1 has a telescopic structure so as to be self-sealed to a rear surface of a die 2. A plug 4 supported by a plug-supporting lever 3 passing through the vessel 1 is held within the die 2. A mother tube 10 is inserted into the vessel 1 with the plug-supporting lever 3 passing therethrough. In addition, the vessel 1 is provided with an oil-supply pipe 6 connected with an oil-supply source (not shown), the oil-supply pipe 6 being provided with a high-pressure pump 7 disposed in the midst thereof.

With such apparatus, in order to manufacture a long tube 20 by subjecting the mother tube 10 to pressurized lubricant drawing, the vessel 1 is filled with a pressurized lubricating oil at a pressure of 500 kgf/cm$^2$ or more through the oil-supply pipe 6 by means of the high-pressure pump 7. A circular gap between the die 2 and the plug 4 is sealed by a choked portion of a mouth of the mother tube 10 and the mother tube 10 is pulled out of the vessel 1 in the direction shown by an arrow in FIG. 3 through the circular gap. Inner and outer surfaces of the mother tube 10 are supplied with the pressurized lubricating oil throughout the drawing step to perfectly seal up the circular gap with the mother tube 10 which is being processed. In addition, the pressurized lubricating oil used for the pressurized lubricant drawing includes, for example, a mixture composite of chlorinated paraffins and sulfurated oils and fats with Cl in a quantity of 10% and S in a quantity of 5% added as ultra-pressure additives but is not specially limited.

The reason why the pressure of the lubricating oil is set at 500 kgf/cm$^2$ or more in the pressurized lubricant drawing of the method according to the present invention is described below.

Figure 4:
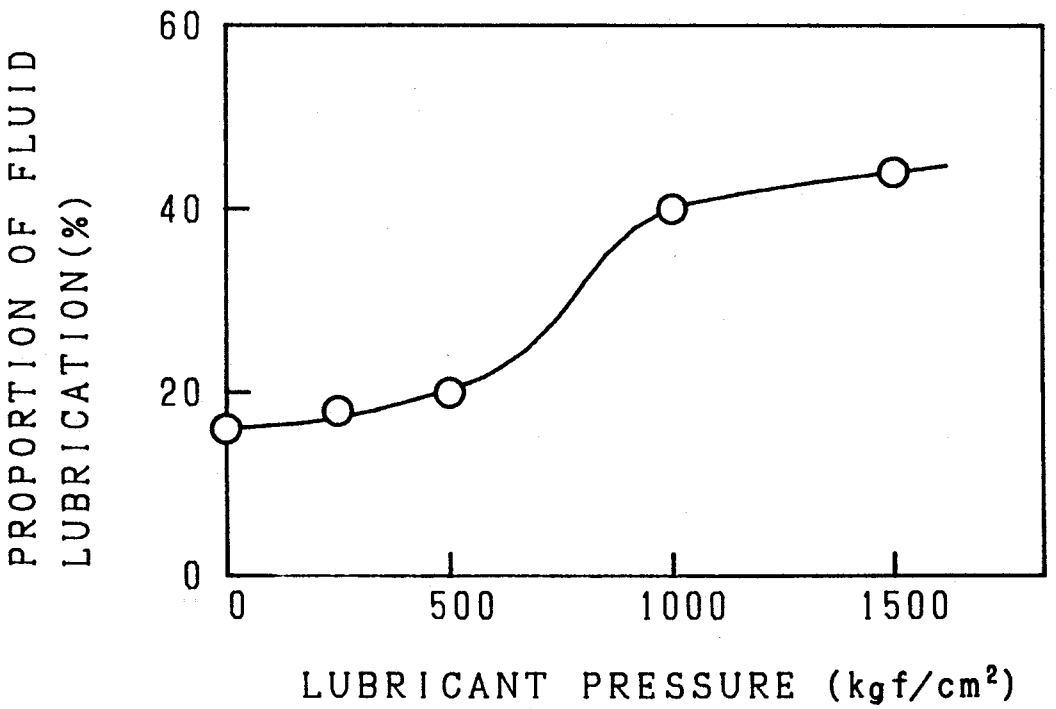
FIG. 4 is a graph showing a relation between a pressure of the lubricating oil and a proportion of fluid lubrication in the plug drawing using a pressurized lubricating oil.

FIG. 4 is a graph showing a relation between the pressure of the lubricating oil (lubricant pressure: kgf/cm$^2$) and the lubricating factor (proportion of fluid lubrication: %) in the plug drawing of SUS 304 steel tubes. The working degree Rd is 46% (an outside diameter of 25 mm, a wall-thickness of 3.5 mm→an outside diameter of 21.6 mm, a wall-thickness of 2.1 mm). The lubricating factor is a proportion of an oil hole area of the drawn tube to a unit tube surface area. The larger this proportion is, the more superior the lubricancy is. In addition, the oil hole area is an area of a portion in which the lubricating oil is put to be retained. As found from FIG. 4, if the pressure of the lubricating oil is less than 500 kgf/cm$^2$, the lubricating factor is hardly influenced by the pressure of the lubricating oil to be on a lower level. If the pressure of the lubricating oil is 500 kgf/cm$^2$ or more, the lubricating factor is increased with an increase of the pressure of the lubricating oil. The lubricating factor at the pressure of the lubricating oil of 1,000 kgf/cm$^2$ or more is 2 times or more that at the pressure of the lubricating oil less than 500 kgf/cm$^2$.

It is dependent upon the possibility of the prevention of the jamming whether the long tube can be manufactured by the plug drawing or not. If the pressure of the lubricating oil is 500 kgf/cm$^2$ or more, the high lubricating factor is secured, as above described, so that the long tube can be stably manufactured by the plug drawing. Since the plug drawing is continuously carried out, the dimensional fluctuation in the axial direction of the tube resulting from the intermittent pushing-in of the mother tube incidental to the cold drawing does not occur. In addition, since it is unnecessary to separate the tube from the mandrel after the drawing, also the very small fluctuation of outside diameter in the axial direction of the tube resulting from the reeling, which has come into question in the mandrel drawing, does not occur.

According to the method of the present invention, 500 kgf/cm$^2$, which is the minimum pressure of the lubricating oil required for making the manufacture of the long tube by the plug drawing possible, is set as the lower limit of the pressure of the lubricating oil but actually 1,000 kgf/cm$^2$ or more is more desirable. The upper limit is not specially limited but if it is 1,000 kgf/cm$^2$ or more, the increasing tendency of the lubricating factor is reduced and also the size of the hydraulic circuit is increased, so that it is desirable in view of the practical operation that the upper limit of the pressure of the lubricating oil is set at 1,500 kgf/cm$^2$ or less.

The working degree in the pressurized lubricant drawing is not specially limited but it is better that the working degree is set at 20 to 50. If the working degree is less than 20%, it becomes difficult to uniformly work all over the section and as a result, the uniform structure is not obtained, while if it exceeds 50%, in particular the tube having a small diameter is cut at the portion, which has been subjected to the drawing, according to circumstances.

Also, the material of the long tube is not specially limited but it seems that stainless steels, Ni-base alloys and the like, which have been used as materials for the high-class heat exchange tube, are particularly effective taking into consideration that, for example, it is used for the heat exchanger and the noise resulting from the very small fluctuation of an outside diameter is prevented by the application of the present invention also in the case where the severe internal eddy-current defect detection is carried out.

A concrete example of the first preferred embodiment is below described.

The mother tube having an outside diameter of 28 mm, a wall-thickness of 1.65 mm and a length of 17 m formed of an Alloy 600 (Ni-base alloy) produced by the hot extrusion-cold rolling was subjected to the pressurized lubricant drawing at various pressures of the lubricating oil to obtain a long tube having an outside diameter of 22.2 mm, a wall-thickness of 1.27 mm and a length of 28 m (the working degree: 39%). This long tube is used as a U letter-shaped heat exchange tube for use in the nuclear power plant. The above described mixture composite with the ultrapressure additives was used as the lubricating oil.

For comparison, the same long tube was manufactured by the conventional mandrel drawing. After the drawing, the reeling was conducted to pull the mandrel out of the tube and then the regulation of the outside diameter by the free-loaded drawing was conducted.

The manufactured long tube was investigated on the incidence of jamming, the internal surface roughness ($R_{MAX}$) and the S/N ratio in the internal eddy-current defect detection with the results shown in Table 1. The internal surface roughness ($R_{MAX}$) was measured in compliance with JIS-0601. In addition, the S/N ratio is a ratio of an output (S) of a signal responding to the standard defect to an output (N) of a signal responding to the dimensional fluctuation. Since the signal on the same one level is put out for the same one defect, the lower the output level of the signal resulting from the dimensional fluctuation is, that is the larger the S/N ratio is, the easier the defect detection is.

TABLE 1

| Manufacturing condition | | Investiation results | | | |
|---|---|---|---|---|---|
| Drawing | * | ** | $R_{MAX}$ (μm) | S/N | Division |
| Pressurized lubricant drawing | 300 | 25 | — | — | Comparative Method of the present invention |
| | 500 | 2 | 2.5 | 18 | |
| | 1,000 | 0 | 2.8 | 17 | |
| | 1,500 | 0 | 3.0 | 15 | |
| | 2,000 | 0 | 3.2 | 13 | |
| Mandrel drawing | | 0 | 6.0 | 3 | Prior art |

*Pressure of lubricating oil (kgf/cm²)
**Incidence of jamming (%)

As shown in Table 1, although the jamming does not occur in the mandrel drawing, it is necessary to regulate the outside diameter by the reeling and the free-loaded drawing after the drawing and the S/N ratio in the internal eddy-current defect detection amounts to 3 even after the regulation of the outside diameter. It is this reason why the very small fluctuation of the outside diameter resulting from the reeling is turned into the very small fluctuation of the inside diameter by the regulation of the outside diameter by the free-loaded drawing, as above described. In addition, the internal surface roughness amounts to 6 μm.

On the contrary, according to the pressurized lubricant drawing of the present invention, when the pressure of the lubricating oil is 300 kgf/cm², the jamming occurs in a quantity of 25% but when the pressure of the lubricating oil is 500 kgf/cm², the jamming occurs is a quantity of 2% and when it is 1,000 kgf/cm² or more, no jamming occurs. Furthermore, the pressurized lubricant drawing according to the present invention is remarkably superior to the mandrel drawing in S/N ratio and internal surface roughness within the pressure range of the lubricating oil of 500 to 2,000 kgf/cm² effective in respect of incidence of the jamming.

Figure 5:
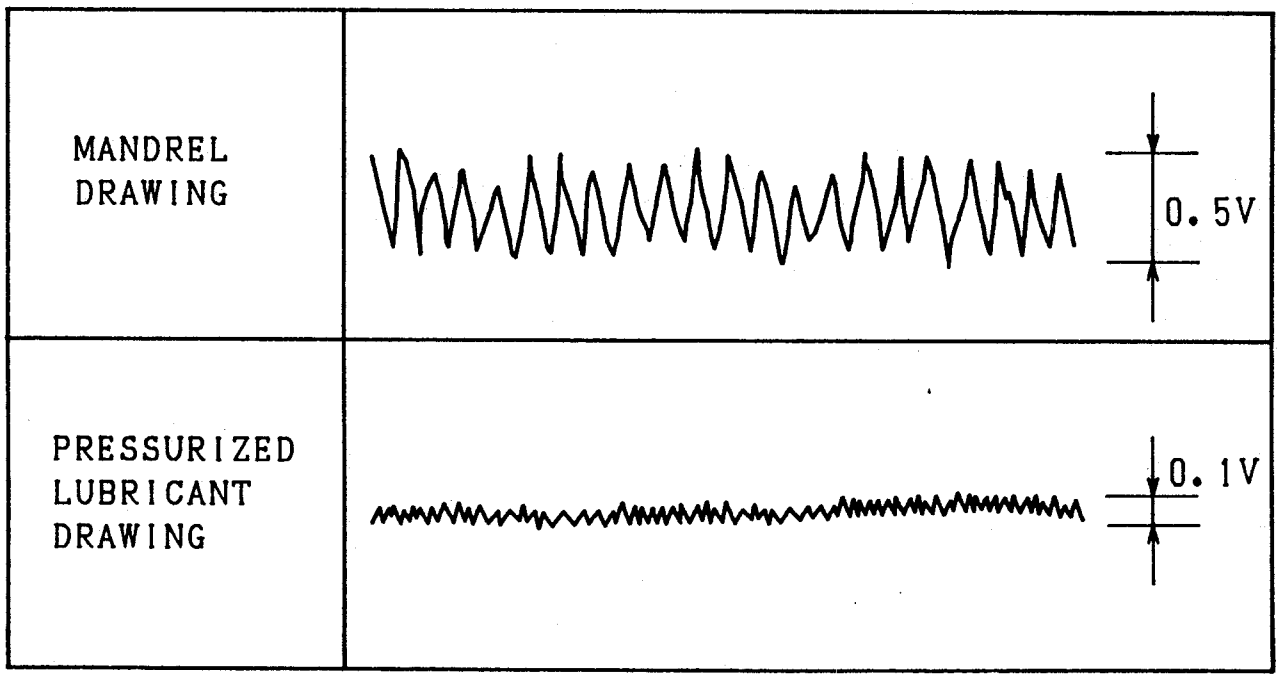
FIG. 5 is a wave-shape diagram showing an internal eddy-current defect detection output in the preferred embodiment of the present invention and the conventional method.

FIG. 5 shows a wave-shape in the internal eddy-current defect detection in the case where the long tube is manufactured by the mandrel drawing and the case where the long tube is manufactured by the pressurized lubricant drawing (the pressure of the lubricating oil: 1,500 kgf/cm²). The noise of 0.5 V resulting from the very small fluctuation of the inside diameter occurs in the long tube manufactured by the mandrel drawing but this noise is suppressed to 0.1 V in the long tube manufactured by the pressurized lubricant drawing. In this time, the signal resulting from the standard defect is regulated at 1.5 V. Accordingly, the magnitude of the signal is not influenced by the noise even though it is about 1/10 times that resulting from the standard defect in the long tube manufactured by the pressurized lubricant drawing and thus the internal defect can be accurately detected.

In the case where the mother tube is subjected to a plurality of cold working steps to manufacture the long tube, at least the final cold work is the pressurized lubricant drawing (P2, 3, 4 in FIG. 1). In such a case, the cold working before the final cold work may be the pressurized lubricant drawing in the same manner as in the final cold work (P2 in FIG. 1, EXAMPLE 2) or the cold rolling (P3 in FIG. 1, EXAMPLE 3) or the mandrel drawing (P4 in FIG. 1, EXAMPLE 4).

Figure 6:
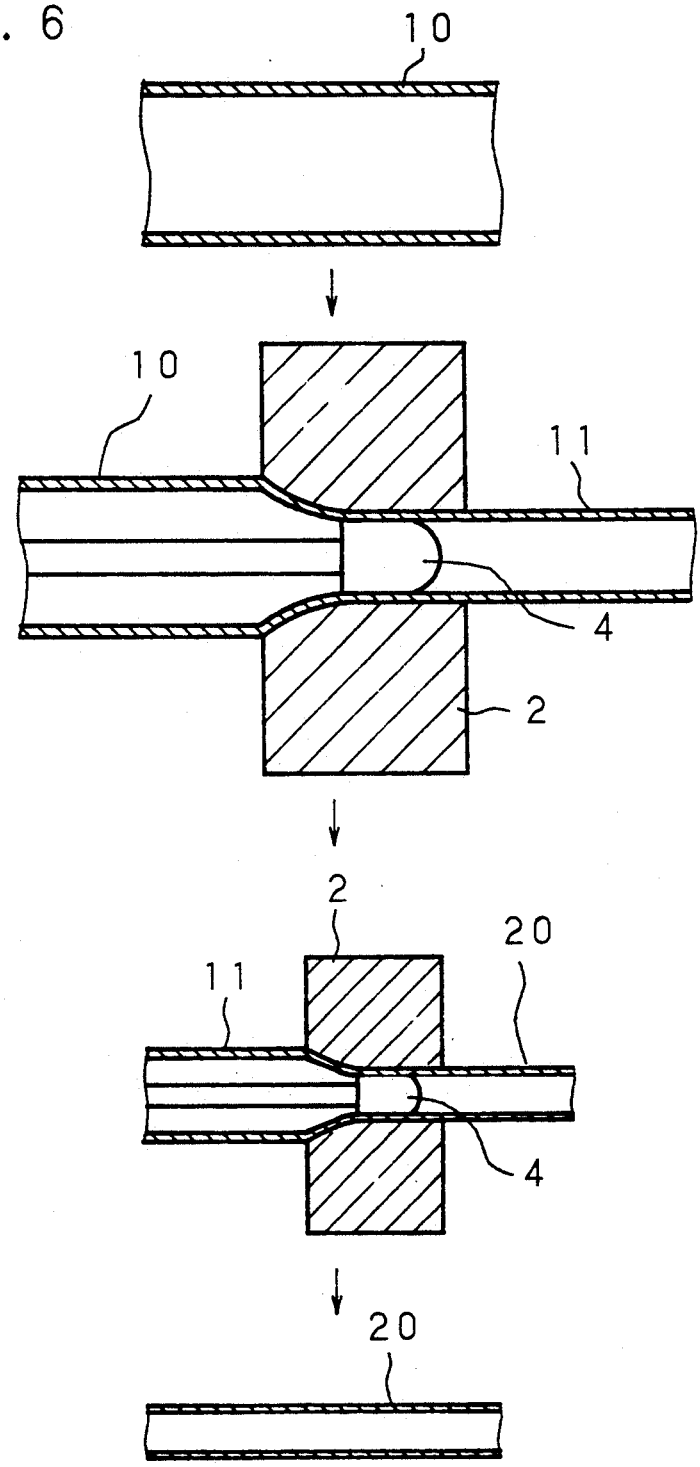
FIG. 6 is a schematic diagram showing a process in a second preferred embodiment of the present invention.

FIG. 6 is a schematic diagram showing the process of EXAMPLE 2. A mother tube 10 is subjected to the pressurized lubricant drawing, as shown in FIG. 3, to be turned into an intermediate tube 11 which is further subjected to the pressurized lubricant drawing using the pressurized lubricating oil of 500 kgf/cm² or more in the same manner as in EXAMPLE 1 to manufacture a long tube 20 as the product.

Figure 7:
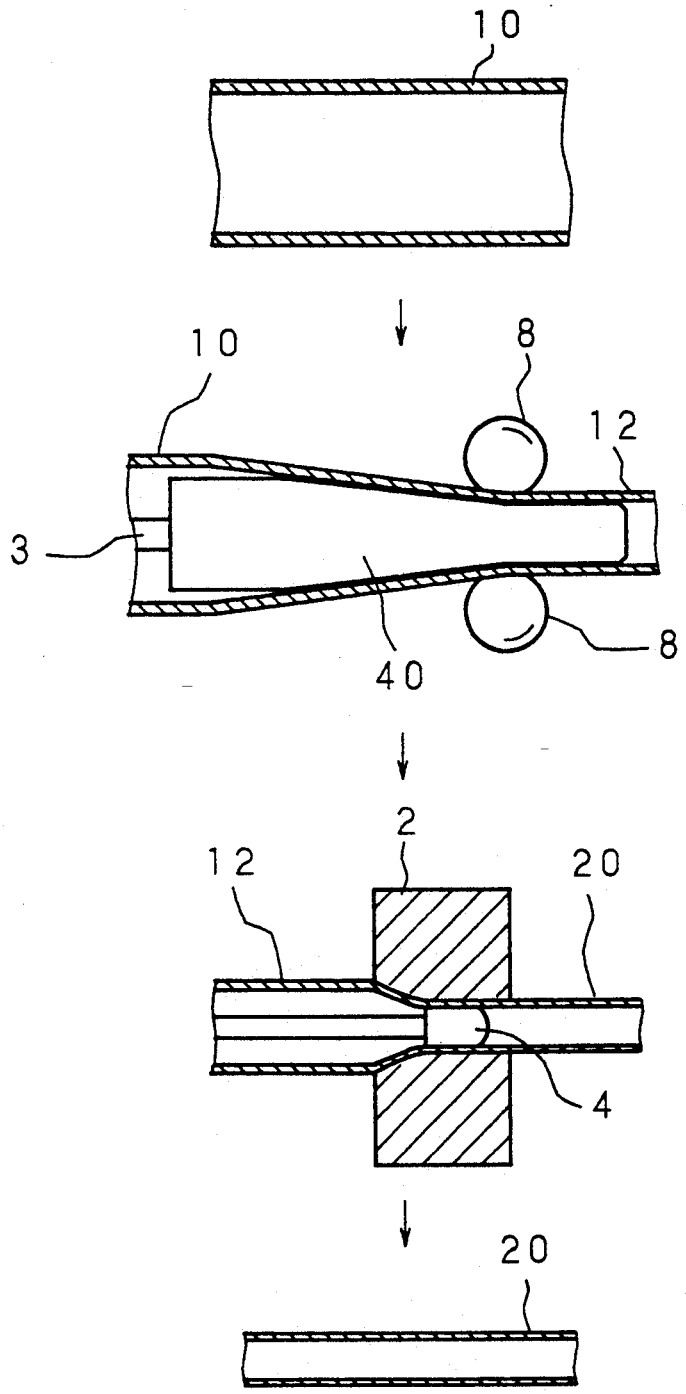
FIG. 7 is a schematic diagram showing a process in a third preferred embodiment of the present invention.

FIG. 7 is a schematic diagram showing the process of EXAMPLE 3. A mother tube 10 with a mandrel 40 supported by a supporting lever 3 inserted thereinto is subjected to cold rolling in the rolling-mill comprising for example two rolls 8, 8 to be turned into an intermediate tube 12 which is further subjected to the pressurized lubricant drawing using the pressurized lubricating oil of 500 kgf/cm² or more in the same manner as in EXAMPLE 1 to manufacture a long tube 20.

Figure 8:
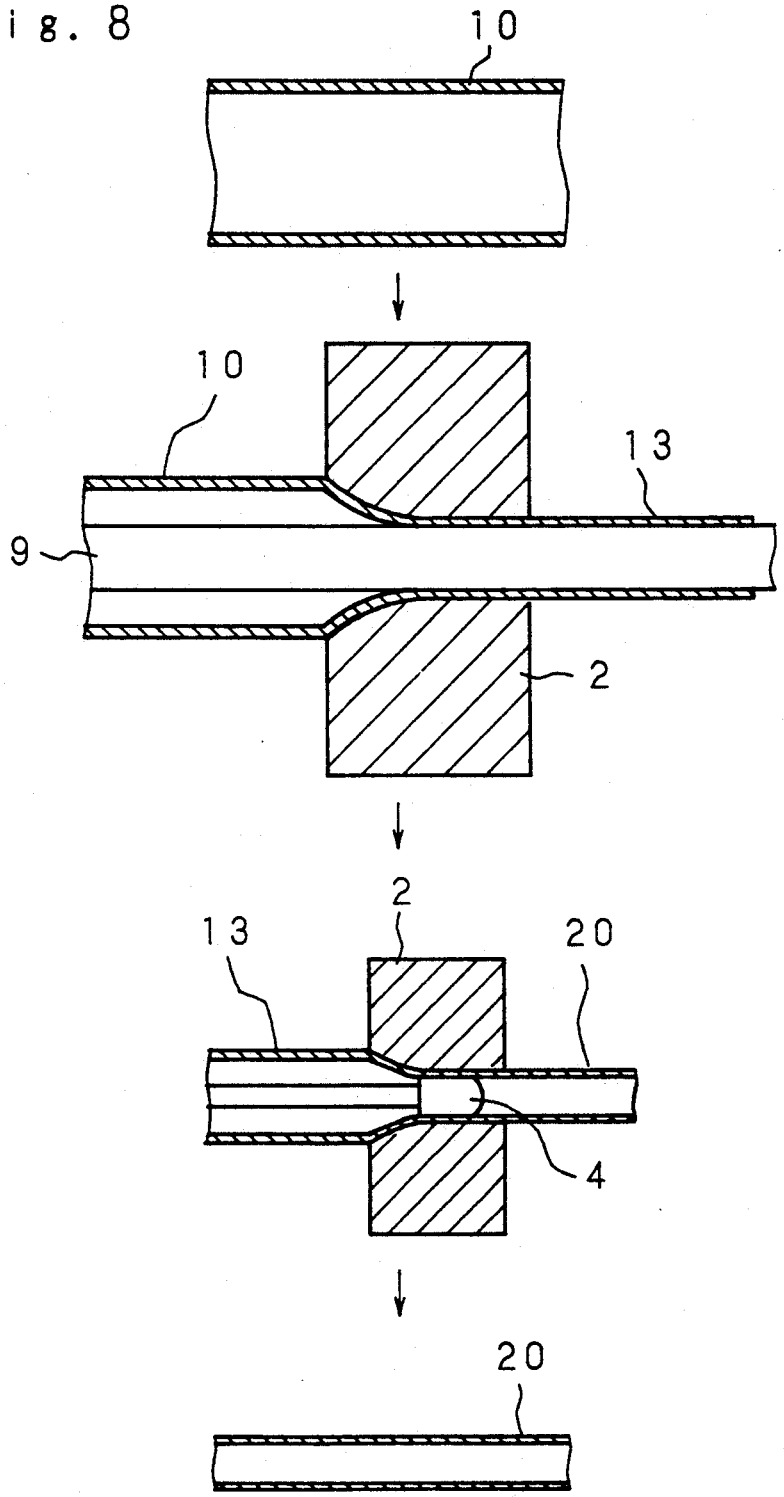
FIG. 8 is a schematic diagram showing a process in a fourth preferred embodiment of the present invention.

FIG. 8 is a schematic diagram showing the process of EXAMPLE 4. A mandrel bar 9 is inserted into a mother tube 10 and the mother tube 10 is drawn out of a die 2 together with the mandrel bar 9 to be turned into an intermediate tube 13 which is further subjected to the pressurized lubricant drawing using the pressurized lubricating oil of 500 kgf/cm² or more in the same manner as in EXAMPLE 1 to manufacture a long tube 20.

In EXAMPLE 2 adopting the pressurized lubricant drawing in all of a plurality of cold working steps, no dimensional fluctuation occurs in the axial direction of the tube not only after the final cold work but also in the cold working preceding the final cold work. Also in EXAMPLE 3 and EXAMPLE 4 adopting the cold rolling and the mandrel drawing, respectively, in the cold working preceding the final cold work, if the pressurized lubricant drawing is adopted in the final cold work, the dimensional fluctuation, which has been produced in the preceding cold works, is eliminated. In addition, in all of EXAMPLES 2, 3, 4, the number of times of the cold working preceding the final cold work may be optional.

Also, in the case where the pressurized lubricant drawing is conducted at the maximum allowable working degree in the final cold work, the tube having the required dimensions can not be obtained after the final cold work according to circumstances. In such the case, if the final pressurized lubricant drawing process is divided in two parts to conduct the respective pressurized lubricant drawing processes at the working degree within the drawable range, the tube having the required dimensions can be obtained. However, in such a case, when the working degree from the dimension after the final drawing process to the required dimension is small, it is convenient to conduct the free-loaded drawing after the final pressurized lubricant drawing.

Figure 9:
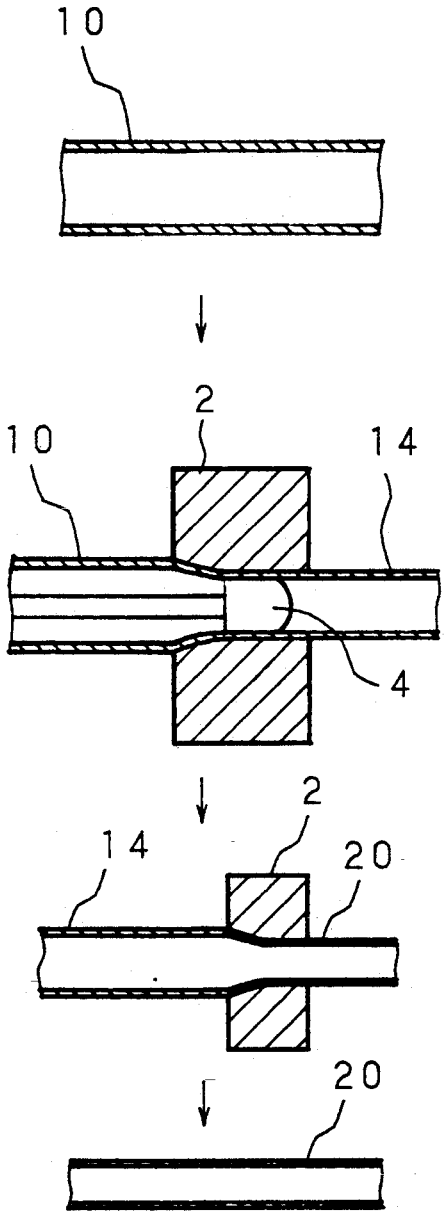
FIG. 9 is a schematic diagram showing a process in a fifth preferred embodiment of the present invention.

Methods, which have been invented under such the circumstances, are EXAMPLES 5 to 8 (P5 to P8 in FIG. 1) of the present invention. FIG. 9 is a schematic diagram showing the manufacturing process of EXAMPLE 5 (P5 in FIG. 1). In EXAMPLE 5, at least the final cold work accompanied by the reduction in wall-thickness for a mother tube 10 is conducted by the pressurized lubricant drawing using the pressurized lubricating oil of 500 kgf/cm$^2$ or more in the same manner as in EXAMPLE 1 to obtain an intermediate tube 14 which is further subjected to the free-loaded drawing, whereby manufacturing a long tube 20. Concretely speaking, the work schedule in the pressurized lubricant drawing, which is the final wall-thickness reducing process, is determined so that the wall-thickness after the final pressurized lubricant drawing may be almost equal to the required wall-thickness and then the reduction in diameter is conducted until obtaining the required outside diameter (or inside diameter) by the free-loaded drawing. In the free-loaded drawing, the wall-thickness working is not substantially conducted but the wall-thickness is slightly increased or reduced according to the shape of the die used. In such a case, it is sufficient that the work schedule of the pressurized lubricant drawing is selected in expectation of the increase or the decrease of wall-thickness during the free-loaded drawing.

The working degree in the free-loaded drawing is set at about 20% or less, preferably about 10% or less. In the free-loaded drawing, the inner surface of the tube is a free surface which is not regulated by the tool, so that the internal surface roughness is slightly increased but the degree of an increase in roughness is reduced at the working degree of about 20% or less. In addition, at the working degree of this extent, no jamming occurs even though the pressurized lubricating oil is not used. Since the free-loaded drawing is conducted using merely the die, the very small dimensional fluctuation in the axial direction of the tube does not occur. Accordingly, even though the tube subjected to the final pressurized lubricant drawing and showing no very small dimensional fluctuation in the axial direction thereof is subjected to the free-loaded drawing, the dimensional fluctuation in the axial direction of the tube does not occur.

The respective long tubes according to EXAMPLE 1 (manufactured by the cold work of the pressurized lubricant drawing and having the characteristics shown in Table 1) were subjected to softening treatment and further the free-loaded drawing followed by investigating the internal surface roughness and S/N ratio with the results shown in the following Table 2. In addition, the lubricating oil used in the free-loaded drawing is same as that used in the pressurized lubricant drawing.

TABLE 2

| Manufacturing conditions | | Investigation results | |
|---|---|---|---|
| Pressure of the pressurized lubricating oil in pressurized lubricant drawing (kgf/cm$^2$) | Working degree in the free-loaded drawing (%) | Internal surface roughness (μm) | S/N |
| 500 | 8 | 3.2 | 18 |
| 1,000 | 8 | 3.5 | 17 |
| 1,500 | 15 | 3.8 | 15 |
| 2,000 | 18 | 4.0 | 13 |

The internal surface roughness is slightly larger than that in the case where merely the pressurized lubricant drawing is conducted but smaller than that shown in Table 1 in the case of the mandrel drawing. In addition, the S/N ratio is fixed before and after the free-loaded drawing and remarkably superior to that in the case of the mandrel drawing.

Figure 10:
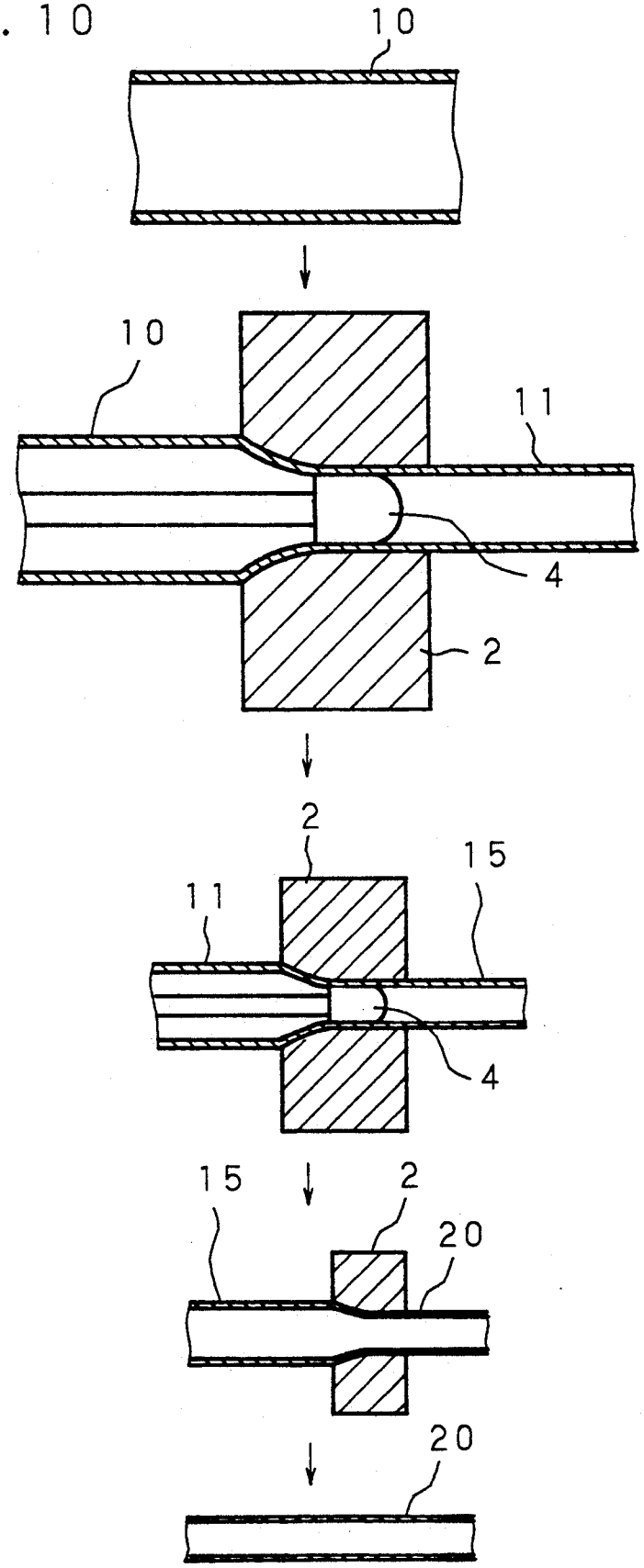
FIG. 10 is a schematic diagram showing a process in a sixth preferred embodiment of the present invention.

FIG. 10 is a schematic diagram showing the process of EXAMPLE 6 (P6 in FIG. 1). In EXAMPLE 6, a mother tube 10 is subjected to the process according to EXAMPLE 2 to obtain an intermediate tube 15 which is subjected to the free-loaded drawing in the same manner as in EXAMPLE 5, whereby manufacturing a long tube 20.

Figure 11:
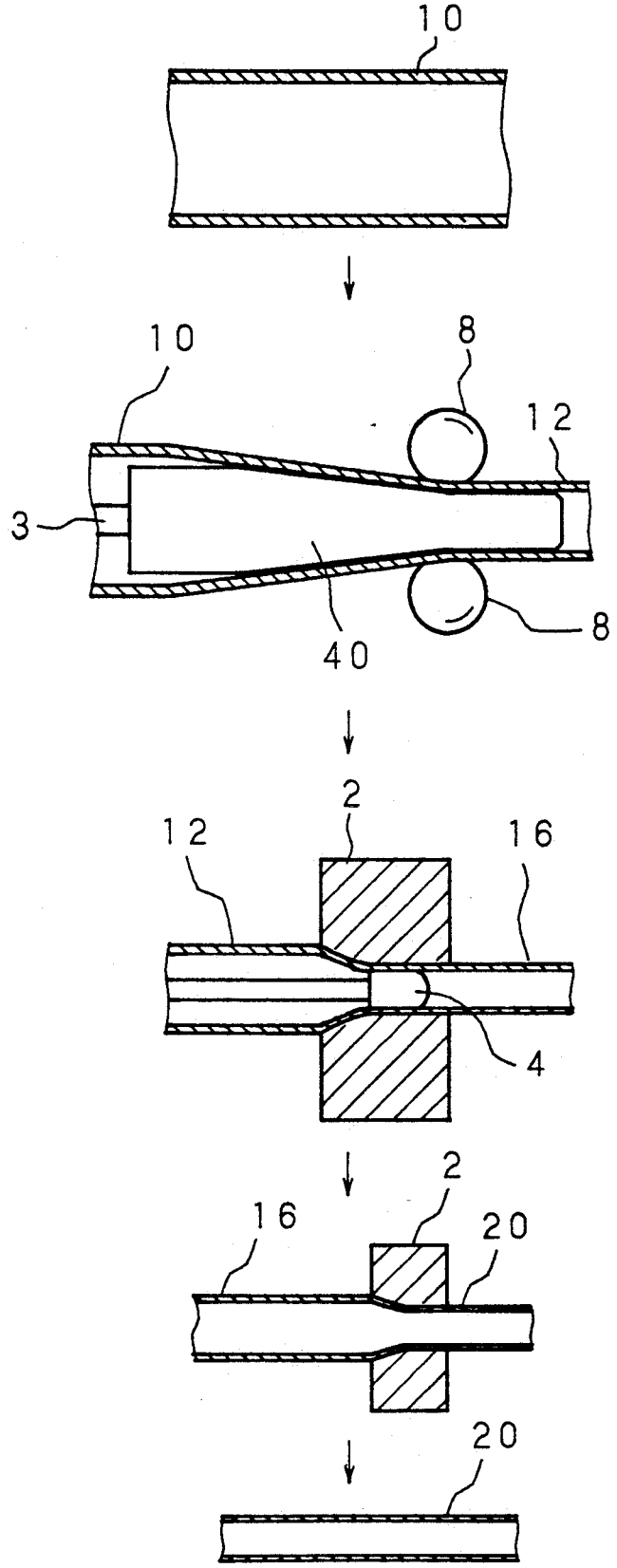
FIG. 11 is a schematic diagram showing a process in a seventh preferred embodiment of the present invention.

FIG. 11 is a schematic diagram showing the process of EXAMPLE 7 (P7 in FIG. 1). In EXAMPLE 7, a mother tube 10 is subjected to the process according to EXAMPLE 3 to obtain an intermediate tube 16 which is subjected to the free-loaded drawing in the same manner as in EXAMPLE 5, whereby manufacturing a long tube 20.

Figure 12:
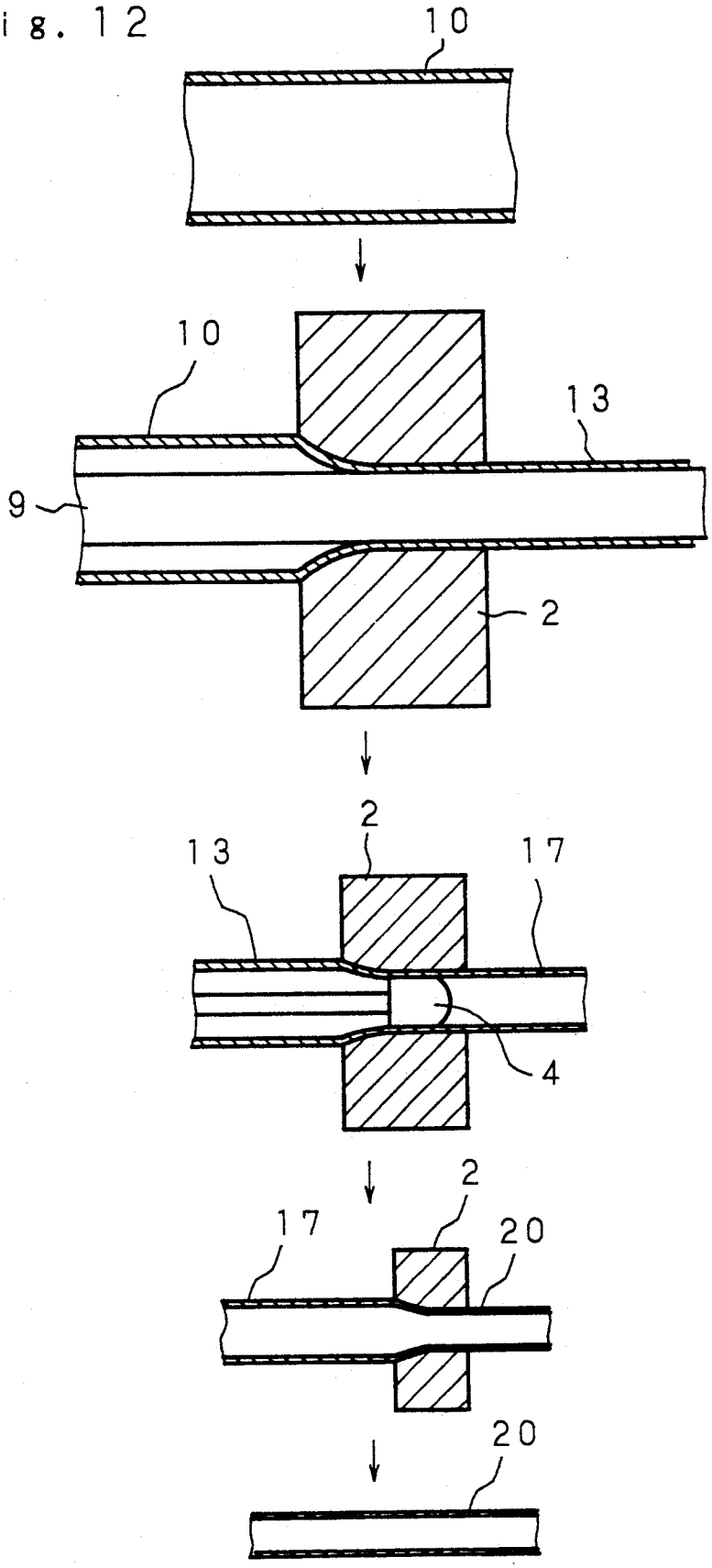
FIG. 12 is a schematic diagram showing a process in an eighth preferred embodiment of the present invention.

FIG. 12 is a schematic diagram showing the process of EXAMPLE 8 (P8 in FIG. 1). In EXAMPLE 8, a mother tube 10 is subjected to the process according to EXAMPLE 4 to obtain an intermediate tube 17 which is subjected to the free-loaded drawing in the same manner as in EXAMPLE 5, whereby manufacturing a long tube 20.

As this invention may be embodied in several forms without departing from the spirit of essential characteristics thereof, the foregoing embodiments are therefore illustrative and not restrictive, since the scope of the invention is defined by the appended claims rather than by the description preceding them, and all changes that fall within the meets and bounds of the claims, or equivalents of such meets and bounds thereof are therefore intended to be embraced by the claims.

What is claimed is:

1. A long tube having a small diameter for use in a heat exchanger of a steam generator in a thermoelectric power plant or a nuclear power plant, being manufactured by a method, in which a mother tube is placed in a vessel filled with pressurized lubricant oil and subjected to one step of plug drawing using the pressurized lubricating oil at a constant pressure in the vessel of 500 kgf/cm$^2$ or more to provide a reduction in wall-thickness of the mother tube, the tube having an internal surface roughness in the as-drawn condition of no greater than 3.8 μm and the tube exhibiting a S/N ratio of at least 13 during internal eddy-current defect detection where S is an output in volts of a signal responding to a standard defect and N is an output in volts of a signal responding to dimensional fluctuation in the tube's internal diameter.

2. The tube of claim 1, wherein the tube has an outside diameter of no greater than 40 mm.

3. The tube of claim 2, wherein the tube has a length of at least 20 meters.

4. The tube of claim 1, wherein the tube is of a nickel-base alloy.

5. The tube of claim 1, wherein the tube is of a stainless steel alloy.

6. The tube of claim 1, wherein the tube is a seamless tube.

7. A long tube having a small diameter for use in a heat exchanger of a steam generator in a thermoelectric power plant or a nuclear power plant, being manufactured by a method, in which a mother tube is subjected to a plurality of cold working steps wherein a final cold working step is performed by plug drawing wherein the mother tube is placed in a vessel filled with pressurized lubricating oil at a constant pressure in the vessel of 500 kgf/cm$^2$ or more to provide a reduction in wall-thickness of the mother tube, the tube having an internal surface roughness in the as-drawn condition of no greater than 3.8 μm and the tube exhibiting a S/N ratio of at least 13 during internal eddy-current defect detection where S is an output in volts of a signal responding to a standard defect and N is an output in volts of a signal responding to dimensional fluctuation in the tube's internal diameter.

8. The tube of claim 7, wherein the tube has an outside diameter of no greater than 40 mm.

9. The tube of claim 8, wherein the tube has a length of at least 20 meters.

10. The tube of claim 7, wherein the tube is a nickel-base alloy.

11. The tube of claim 7, wherein the tube is of a stainless steel alloy.

12. The tube of claim 7, wherein the tube is a seamless tube.

13. A long tube having a small diameter for use in a heat exchanger of a steam generator in a thermoelectric power plant or a nuclear power plant, being manufactured by a method, in which a mother tube is placed in a vessel filled with pressurized lubricant oil and subjected to plug drawing using the pressurized lubricating oil at a constant pressure in the vessel of 500 kgf/cm$^2$ or more as a final cold working step to provide a reduction in wall-thickness of the mother tube and a free-loaded drawing being conducted after said plug drawing, the tube having an internal surface roughness in the as-drawn condition of no greater than 3.8 μm and the tube exhibiting a S/N ratio of at least 13 during internal eddy-current defect detection where S is an output in volts of a signal responding to a standard defect and N is an output in volts of a signal responding to dimensional fluctuation in the tube's internal diameter.

14. The tube of claim 13, wherein the tube has an outside diameter of no greater than 40 mm.

15. The tube of claim 14, wherein the tube has a length of at least 20 meters.

16. The tube of claim 13, wherein the tube is of a nickel-base alloy.

17. The tube of claim 13, wherein the tube is of a stainless steel alloy.

18. The tube of claim 13, wherein the tube is a seamless tube.

* * * * *